United States Patent [19]

Welliver

[11] Patent Number: 4,483,104

[45] Date of Patent: Nov. 20, 1984

[54] DRILL BIT SHARPENER

[76] Inventor: Edward V. Welliver, 3522 Rotary Rd., Rockford, Ill. 61109

[21] Appl. No.: 363,520

[22] Filed: Mar. 30, 1982

[51] Int. Cl.³ ..... B24B 19/00

[52] U.S. Cl. ..... 51/219 R

[58] Field of Search ..... 269/71; 51/219 PC, 219 R; 279/46, 59, 47; 33/185 R

[56] References Cited

U.S. PATENT DOCUMENTS

| | | | |
|---|---|---|---|
| 2,109,308 | 2/1938 | Adams . | |
| 2,325,364 | 7/1943 | Boening | 51/219 PC |
| 2,670,215 | 2/1954 | Fishwick . | |
| 2,797,538 | 7/1957 | Studler . | |
| 2,958,167 | 11/1960 | Mueller . | |
| 3,664,031 | 5/1972 | Duffy | 33/185 R |
| 3,894,340 | 7/1975 | Ellis | 33/185 R |
| 4,001,975 | 1/1977 | Bernard et al. | 51/5 R |
| 4,176,499 | 12/1979 | Mazoff | 51/124 R |
| 4,266,789 | 5/1981 | Wahl et al. | 279/60 |

*Primary Examiner*—Frederick R. Schmidt
*Assistant Examiner*—Judy J. Hartman
*Attorney, Agent, or Firm*—Berman, Aisenberg & Platt

[57] ABSTRACT

Apparatus for holding a drill bit to be sharpened comprises a chuck having jaws which ride in guide grooves for accurately centering the drill bit. The chuck is formed on a conical end portion of a cylindrical, rotatable element, and is capable of accurate alignment by economical manufacturing methods. The chuck also carries a cam surface for producing reciprocative motion to the drill bit. The rotatable element is mounted for pivotal motion about a horizontal axis and a second axis normal to the horizontal axis.

14 Claims, 5 Drawing Figures

DRILL BIT SHARPENER

TECHNICAL FIELD

This invention relates to apparatus for holding a drill bit to be sharpened, and is designed principally for the do-it-yourself trade, using any bench grinder.

BACKGROUND ART

Apparatus for sharpening drill bits are known. In the patent to Adams, U.S. Pat. No. 2,109,309 there is shown a quite complex drill sharpening apparatus which provides cams for simultaneously advancing the drill bit toward the grinding wheel and for rotating the drill bit about an axis transverse to the drill. This structure is quite complicated and requires precision machining to insure proper sharpening of the drill bit. The U.S. patent to Studler, U.S. Pat. No. 2,797,538 shows an apparatus for holding a tool to be sharpened. The Studler apparatus allows for angular adjustment only about an axis normal to the axis of the tool being sharpened and again requires many parts to be precision-machined to insure correct sharpening of the tool. The patent to Mueller, U.S. Pat. No. 2,958,167 shows a device similar to that shown by Studler except for variations in the chuck and other small features which are not pertinent to the present invention. The device shown by Bernard et al, U.S. Pat. No. 4,001,975 shows a complete drill bit sharpening device wherein the drill bit is placed into a chuck in one part of the device and aligned; the chuck is then moved to a holder at another part of the apparatus for sharpening. This apparatus is quite expensive and complex.

Chucks for holding a drill bit are known generally. The U.S. patent to Fishwick, U.S. Pat. No. 2,670,215 provides a chuck having jaws which ride in grooves in a cylindrical element in the inner part of the chuck, and which provides springs for rotating the jaws so as to open them to receive the shank of a drill bit. The patent to Wahl, U.S. Pat. No. 4,266,789 shows a chuck similar to that shown by Fishwick. Both of the chucks to Fishwick and Wahl utilize jaws having slanted surfaces which coact with a conical surface on the nut of the chuck. This arrangement does not allow a high degree of alignment precision, with low cost production methods.

STATEMENT OF THE INVENTION

The invention is an economical apparatus for use in sharpening a drill bit and which provides a high degree of alignment precision. The precision is achieved through the use of several features which cooperate to permit a high degree of precision and yet which may be produced inexpensively.

The apparatus of the invention includes a rotatable element which is carried by a bearing. The rotatable element is tubular along most of its length and one end is flared to form a conical chuck end portion. Mounted on the conical end portion is an element which includes a camming surface and provides slots for the jaws of the chuck. These jaws are long enough to contact a minimum of two spirals of the drill. The camming surface cooperates with a feed screw mounted on the bearing for providing a reciprocative motion to the rotatable means. The guide slots maintain the motion of the jaws of the chuck in a radial direction insuring that the drill bit is always centered, or aligned with the rotational axis. By combining the camming surface with the guides for the jaws of the chuck a single molded element may be produced which provides alignment of the drill both with respect to the cam surface and with respect to the center of the rotatable element.

The rotatable element is carried in a bearing and the bearing is pivotably mounted on a platform. The platform is in turn rotatably mounted to a base, and the axis of rotation of the platform is orthogonal to the axis of rotation of the bearing. This arrangement allows for the drill bit to be oriented about a horizontal axis so that the angle of the cutting face may be adjusted, and also allows for rotation of the drill bit about an axis perpendicular to the axis of the drill bit for producing heel clearance on the drill bit.

An alignment gauge is provided for establishing the relationship between the cam surface and the cutting surface of the drill bit. The gauge is used for alignment of the cutting edge with respect to a side face of one jaw of the chuck. The guide grooves for the jaws insure that one of the jaws may be used as a reference surface for aligning the drill bit.

DETAILED DESCRIPTION OF THE DRAWINGS

Figure 1:
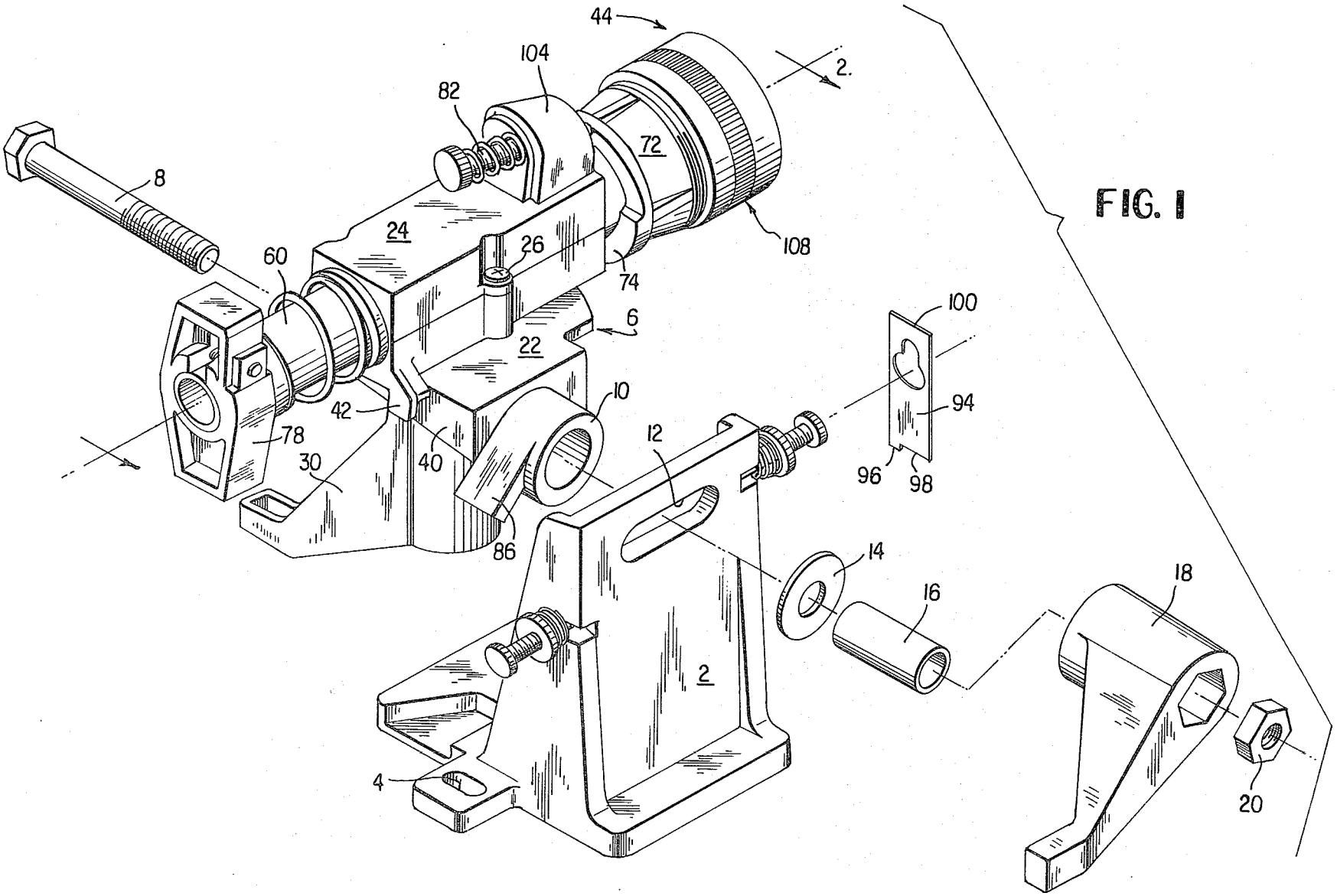
FIG. 1 is an exploded perspective view of the apparatus of the invention.

The major functional elements of the apparatus of the invention are shown in FIG. 1. A base 2 is designed to be secured to a horizontal surface by means of screw holes, one of which is shown at 4. A platform 6 is rotatably mounted to the upstanding portion of the base 2 by means of a bolt 8 which passes through a cylindrical portion 10 of the platform and a slot 12 in the upstanding portion of the base. A washer 14 and cylindrical sleeve 16 fit inside a recess in an arm 18, and a nut 20 mates with the threaded end of bolt 8 to secure the platform to the base. When the arm is rotated in a counterclockwise direction the connection is loosened and the platform may be rotated about a horizontal axis. Since the slot 12 is elongated, the platform may also be moved in a direction parallel to the slot.

Figure 2:
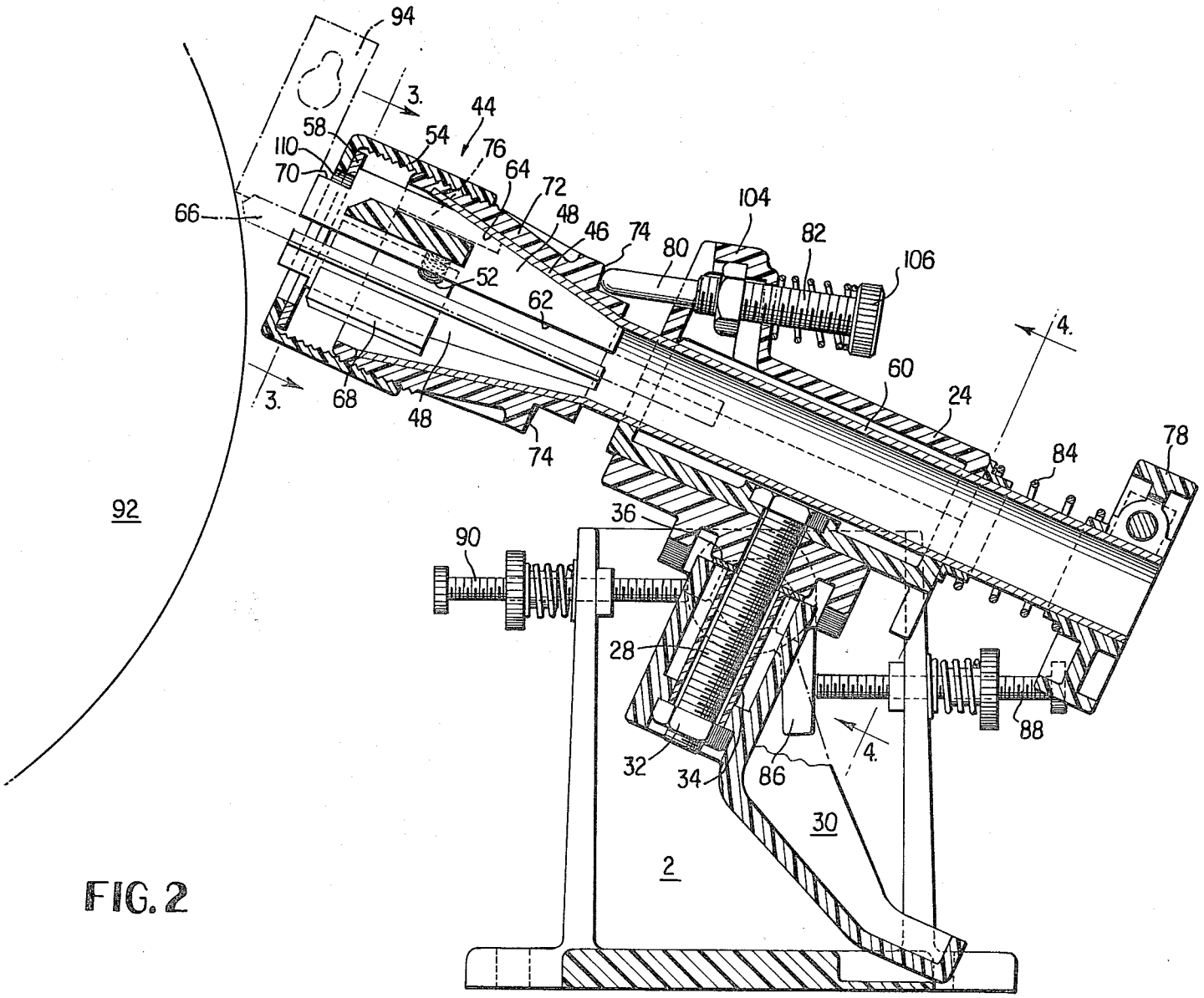
FIG. 2 is a cross section of the apparatus of the invention taken along line 2—2 of FIG. 1.
Figures 3, 4, 5:
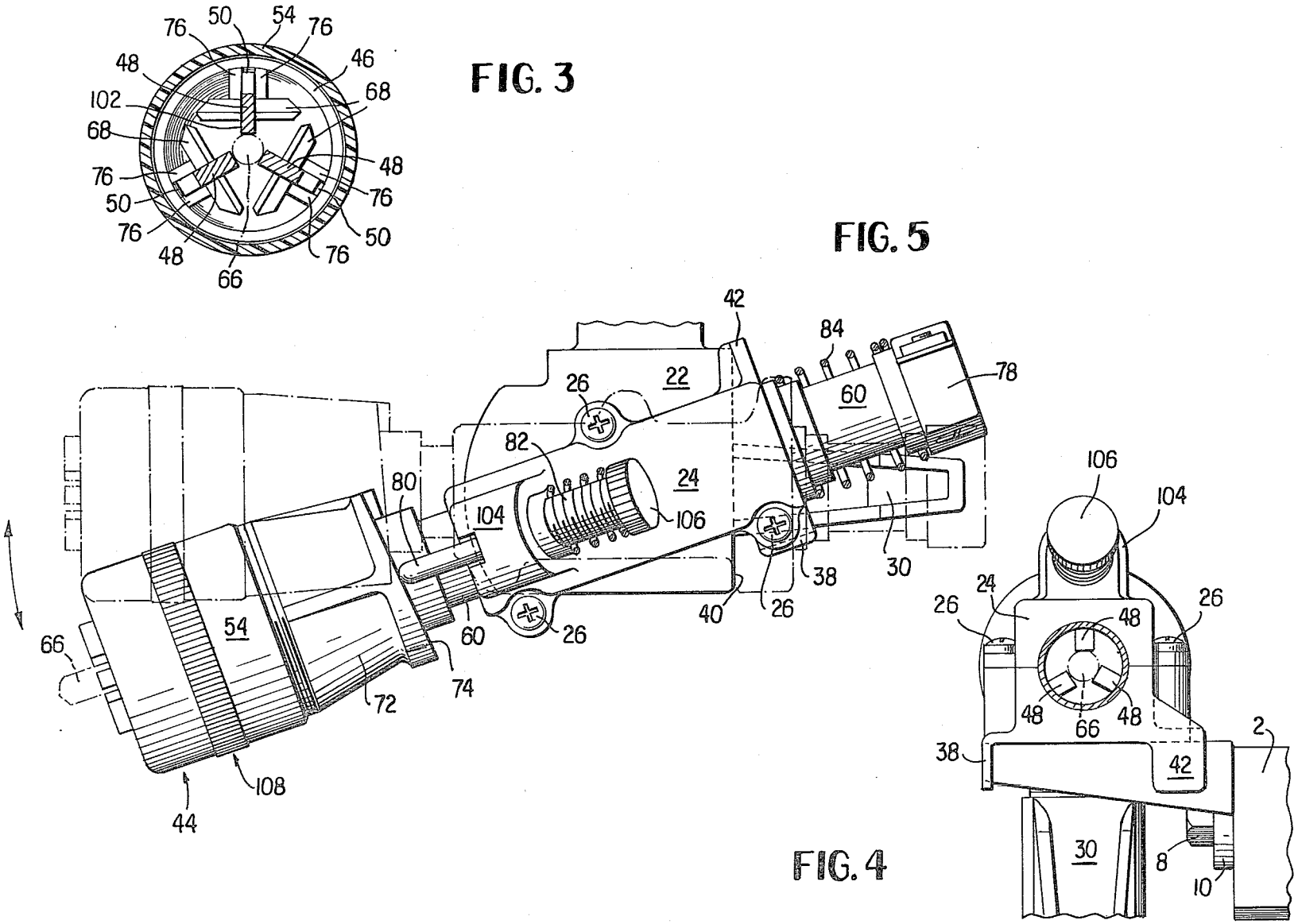
FIG. 3 is a cross section of the chuck of the invention taken along line 3—3 of FIG. 2.
FIG. 4 is a cross section of the apparatus of the invention taken along line 4—4 of FIG. 2.
FIG. 5 is a top view showing how the bearing is rotatably attached to the platform.

Rotatably mounted on a flat surface 22 of the platform 6 is a bearing 24 which may comprise two blocks having semicylindrical areas therein, and which are secured together by screws 26. As more clearly seen in FIG. 2, the bearing is mounted to the platform 6 by means of a bolt 28, and, in a manner similar to the connection between the platform 6 and base 2, an arm 30 contains a nut 32 which mates with the bolt 28 to secure the arm 30, a cylindrical sleeve 34, and a washer 36 together. The bearing means is thus rotatable with respect to the platform and the axis of rotation is perpendicular to, and intersects, the axis of rotation of the platform. As seen in FIG. 5, an ear 38 mates with a surface 40 of the platform, when the bearing is at a position such that the longitudinal axis of the bearing is perpendicular to the axis of rotation of the platform about the base. When the bearing is rotated to produce the heel relief on the drill bit, as will be more fully explained below, the platform 6 is pivoted to the desired angle between the axis of the drill bit and the axis of rotation of the platform about the base.

The portion of the inventive apparatus which serves to grasp the drill bit and to provide a reciprocatory motion to the drill bit will now be described. The drill bit 66 is secured in a chuck 44. The chuck 44 comprises a conical end portion 46, jaws 48, grooves 50 in which the jaws ride, springs 52, nut 54, and cone washer 58. The conical end portion 46 is a flared out portion of a tube 60 which is carried in the bearing 24. The jaws 48 each have one surface 62 which is parallel to the axis of rotation of the tube 60, and also have a surface 64 which is inclined relative to the surface 62. When the jaw 48 moves along the axis of rotation of the tube 60 in response to movement of the nut 54, the surface 62 moves in a radial and axial direction, but remains parallel to the axis of rotation of the tube 60. Grooves 50, between protuberances 76, insure that the jaws 48 move in a radial direction centered on the axis of rotation of the tube 60. This motion insures that the drill bit 66 is secured in a position so that the cylindrical axis of the drill bit is always aligned with the axis of rotation of the tube 60. Each jaw 48 includes a plastic wing 68 which extends outwardly from each jaw, and springs 52 extend between adjacent wings 68 to urge the surfaces 64 of the jaws against the conical surface 46. The nut 54 is threaded, and upon rotation moves parallel to the axis of rotation of the tube 60, and contacts an edge of the jaws 48 through a cone washer 58. Nut 54 has knurled surface 108 to facilitate hand-tightening of the nut 54. The shoulder 110 of the cone washer serves to prevent the jaws from expanding too far by catching notches 70 in each of the jaws. It will be seen that the nut 54 acts to move the jaws along the axis of the conical portion 46 to secure a drill bit.

It is an important feature of the invention that the conical portion 46 is integral with the tube 60 so that the axis of the conical portion may be inexpensively aligned with the axis of rotation of the conical tube 60. This arrangement means that there is no fine machining necessary to insure alignment of the drill bit with the axis of rotation of the tube.

Surrounding the conical portion 46 is a molded plastic element 72 which includes a camming surface 74. The molded plastic element 72 also includes (see FIG. 3) the protuberances 76. These are triangular in cross section in a plane parallel to the flat side 102 of the jaw, and form the grooves 50. The protuberances 76 extend from the upper edge of the element 72 toward the axis of rotation of the tube, and then extend rearwardly. They thus "hook over" the edge of the conical portion 46. Combining the protuberances 76 and the camming surface in a common molded plastic element 72 allows for alignment between the camming surface and the jaws of the chuck. The advantageous reason for this alignment will be described below with respect to the operation of the apparatus.

The tube 60 is carried by the bearing means 24 and the axis of rotation of the tube 60 is aligned with the axis of the bearing means. The tube 60 is provided with a handle 78 for facilitating rotation. A cam advancer 80, which includes a threaded portion 82 is mounted on an extension 104, of the bearing means 24. The advancer 80 rides against the cam surface 74 and the average position of the tube 60 may be set by rotating follower 80 with knurled knob 106. The cam surface 74 is urged against cam advancer 80 by means of a spring 84 which exerts force between the handle 78 and the bearing means 24. When the handle 78 is rotated, the tube 60 and the chuck 44 rotate thus rotating the drill bit 66. Due to the action of the cam advancer and the camming surface 78, the tube 60 advances and retreats as it is rotated.

The cylindrical portion 10 of the platform 6 has a tangential arm 86. As seen in FIG. 2, the angular relationship between the base 2 and bearing means may be adjusted by adjusting the lengths of first and second screws 88 and 90. The first screw 88 contacts the tangential arm 86 and the second screw 90 contacts the outer circumference of the cylindrical portion 10. By adjusting the length of these screws the angular orientation of the apparatus may be adjusted.

OPERATION

The use of the inventive apparatus to sharpen a common twist drill bit will now be described. The apparatus is mounted on a platform in front of a circular grinding wheel 92. The bearing and platform means are rotated about a horizontal axis by rotating arm 18, and the chuck 44 is moved to a position so that the drill bit 6 may be inserted between the jaws 48. The drill bit 66 is then aligned with respect to the cam surface by the use of the gauge 94. The gauge 94 has two ends which may be used for aligning the drill bit. The first end has surfaces 96 and 98 forming a step and the second end has surface 100 which is planar. The gauge 94 is employed by placing one surface against side 102 of a jaw 48 and by aligning the cutting edge of the drill bit with respect to the same surface. For example, when a drill bit of from $\frac{1}{8}$ to $\frac{1}{4}$ inch diameter is to be sharpened, the surface 98 is put against the side 102 of a jaw and the cutting edge of the drill is aligned with surface 96. The particular jaw 48 which should be used for aligning the drill bit is marked on the camming surface 74 by any convenient index, such as a line, so that the particular jaw used for aligning the drill bit is aligned with a predetermined position on the camming surface. For drill bits which are $\frac{1}{4}$ to $\frac{3}{8}$ inch in diameter, the surface 100 of the template is employed to align the side 102 of jaw 48 with the cutting surface of the drill bit. When drill bits from $\frac{3}{8}$ to $\frac{1}{2}$ inch in diameter are to be sharpened the surface 96 is placed against the side 102 of the jaw 48 and the cutting edge is aligned with the surface 98.

After the cutting edge of the drill bit is aligned with the camming surface, the nut 54 is rotated so as to clamp the drill bit 66 tightly in the chuck. The bearing means and the platform are then rotated to the general position shown in FIG. 2 such that the cutting edge of the drill bit is parallel to the grinding surface of the wheel 92. During this operation the shoulder 38 should be in contact with the surface 40. The drill bit is now ready to be sharpened. The drill bit is advanced toward the grinding wheel 92 by turning knurled knob 106 and rotating screw 82. When the drill bit makes contact with the grinding wheel, the handle 78 is rotated thus rotating the drill bit and simultaneously advancing it into the grinding wheel. The cam surface 74 has two high portions 180° with respect to each other. This motion sharpens each of the cutting surfaces of the drill bit and provides for a relief area behind the cutting surfaces, as is required for twist drill bits. If, after rotating handle 78 one complete rotation, it appears to the operator that an inadequate amount of material has been removed from the drill bit, the drill bit may be advanced further toward the grinding wheel by rotation of the screw 82, and another rotation of the drill bit made.

Heel clearance is produced, after sharpening of the cutting edges, by loosening the arm 30 so as to allow the bearing means 24 to rotate with respect to the platform 6 as shown in FIG. 5. This operation will allow the grinding wheel to remove a small amount of the outer portion of the drill bit, thus providing heel clearance.

What is claimed is:

1. Apparatus for holding a tool to be sharpened comprising:

bearing means having a longitudinal axis, rotatable means received by said bearing means and having an axis concentric with said bearing means axis, said rotatable means having a conical end portion, cam means mounted on said conical end portion having a camming surface transverse to said axis of said rotatable means for imparting a reciprocative motion about a pre-selected average position to said rotatable means as said rotatable means rotates, a plurality of jaws which cooperate with said conical end portion to grasp a cylindrical tool such that the longitudinal axis of the tool is aligned with said bearing axis and said rotatable means axis, a cam advancer for cooperating with said camming surface to impart said reciprocative motion, said conical end portion including guide means for each of said jaws for maintaining the motion of each of said jaws in a constant radial direction with respect to said rotatable axis, said cam advancer having one end for engaging said camming surface and being adjustable to alter the axial location of said one end to set said pre-selected average position of said rotatable means, whereby when said rotatable means rotates, said tool rotates coaxially therewith and reciprocates along said bearing means axis.

2. Apparatus of claim 1 wherein said guide means and said cam means are integral.

3. Apparatus of claim 1 further comprising spring means between pairs of said jaws for urging said jaws against said conical end portion.

4. Apparatus of claim 1 further comprising:

a base for supporting said bearing means, wherein said bearing means is mounted to said base for rotation about a horizontal axis transverse to said longitudinal axis when said base is mounted on a horizontal surface.

5. Apparatus according to claim 4 wherein said bearing means is also mounted to said base for rotation about an axis perpendicular to said horizontal axis.

6. Apparatus according to claim 1 further comprising resilient means for urging said camming surface against said cam advancer.

7. Apparatus according to claim 5 wherein said base includes a planar portion having an elongate slot, and wherein said bearing means is supported by a platform, and said platform is mounted on said base, so that said bearing means rotates about said perpendicular axis with respect to said platform and said platform rotates about said horizontal axis.

8. Apparatus according to claim 7 wherein said platform includes means for mounting said platform to said base comprising a hollow cylinder having an arm which extends tangentially from an exterior surface, and a shaft which extends through said hollow cylinder and said elongate slot to rotatably mount said platform to said base and further including stop means secured to said base adapted to contact said exterior surface and said arm for adjustably holding said platform in a predetermined orientation.

9. Apparatus according to claim 8 wherein said stop means comprises two screws, mounted on said base to advance in opposite directions parallel to the elongate direction of said elongate slot.

10. Apparatus according to claim 1 wherein said guide means is at a predetermined orientation with respect to said camming surface such that one of said jaws may be employed for aligning cutting edges of said tool with said camming surface.

11. Apparatus of claim 10 further comprising:

an alignment gauge having at least one planar edge and one edge having two planar surfaces forming a step, said planar edge being adapted to engage a side of one of said jaws to align a pre-determined portion of said tool, and said two planar surfaces are arranged such that one of said two planar surfaces may be placed against a side of one of said jaws and a second of said two planar surfaces may be used to align said tool.

12. Apparatus according to claim 10 wherein said guide means and cam means are integral.

13. Apparatus for holding a tool to be sharpened comprising bearing means having a longitudinal axis, rotatable means received by said bearing means and having an axis concentric with said longitudinal axis, said rotatable means having a conical end portion, cam means on said conical end portion comprising a camming surface for imparting a reciprocative motion to said rotatable means as said rotatable means rotates, jaw means carried by said conical end portion for grasping said tool, said conical end portion having guide means for engaging said jaw means, said guide means being integrally formed with said cam means whereby said jaw means is automatically aligned with a pre-determined position on said camming surface.

14. Apparatus according to claim 13 wherein said rotatable means comprises a cylindrical tube flared at one end to form said conical end portion, said cam means comprises a molded element at least partially surrounding an outer surface of said conical end portion, and said guide means comprise an element which extends over an edge of said conical end portion and into the interior of said conical end portion.

* * * * *